US010149998B2

(12) United States Patent
Wu

(10) Patent No.: US 10,149,998 B2
(45) Date of Patent: Dec. 11, 2018

(54) EXERCISER DEVICE INCLUDING HANDLES WITH SPRINGS

(71) Applicant: Yung-Cheng Wu, Tainan (TW)

(72) Inventor: Yung-Cheng Wu, Tainan (TW)

( * ) Notice: Subject to any disclaimer, the term of this patent is extended or adjusted under 35 U.S.C. 154(b) by 71 days.

(21) Appl. No.: 15/451,468

(22) Filed: Mar. 7, 2017

(65) Prior Publication Data

US 2018/0250546 A1 Sep. 6, 2018

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/055*** | (2006.01) |
| ***A63B 23/02*** | (2006.01) |

(52) U.S. Cl.

CPC ..... *A63B 21/4035* (2015.10); *A63B 21/023* (2013.01); *A63B 21/0407* (2013.01); *A63B 21/0557* (2013.01); *A63B 21/4005* (2015.10); *A63B 21/4025* (2015.10); *A63B 23/0233* (2013.01)

(58) Field of Classification Search

None

See application file for complete search history.

(56) References Cited

U.S. PATENT DOCUMENTS 2,714,008 A * 7/1955 Urban ..... A63B 21/00043 482/126
3,049,130 A * 8/1962 Fuschetti ..... A45D 44/00 132/333
3,820,781 A * 6/1974 Kane ..... A63B 21/0004 473/227
4,623,146 A * 11/1986 Jackson ..... A63B 21/05 482/106
4,770,414 A * 9/1988 Fredrickson ..... A63B 23/0211 482/148
4,789,154 A * 12/1988 Mattox ..... A63B 21/0552 482/10
4,863,158 A * 9/1989 Tassone ..... A63B 21/0004 482/106
D320,636 S * 10/1991 Eckler ..... D21/680
5,868,651 A * 2/1999 Washington ..... A63B 21/00043 482/122
5,935,049 A * 8/1999 Hamm ..... A63B 21/0004 482/108
6,022,302 A * 2/2000 McBride ..... A63B 21/00043 482/121
6,126,581 A * 10/2000 Hartsel ..... A63B 21/0004 482/140
6,129,650 A * 10/2000 Wedge, Jr. ..... A63B 71/0009 482/139
7,285,079 B2 * 10/2007 Mandell ..... A63B 21/00043 482/126
7,314,438 B1 * 1/2008 Clark ..... A63B 21/0455 482/107

(Continued)

*Primary Examiner* — Stephen R Crow

(74) *Attorney, Agent, or Firm* — Alan D. Kamrath; Kamrath IP Lawfirm, P.A.

(57) ABSTRACT

An exerciser device includes a yoke having a first end and a second end spaced from the first end in an axial direction. The yoke further includes a neck between the first and second ends. Two handle units are respectively mounted to the first and second ends of the yoke. Each of the two handle units includes a handle and a tension spring mounted between the handle and the yoke.

14 Claims, 10 Drawing Sheets

(56) References Cited

U.S. PATENT DOCUMENTS

| | | | | |
|---|---|---|---|---|
| 8,672,818 | B2 * | 3/2014 | Welch | A63B 21/0724<br>482/132 |
| 9,005,087 | B1 * | 4/2015 | Betoney, Jr. | A63B 21/06<br>482/104 |
| 9,332,823 | B2 * | 5/2016 | Rattei | A45F 3/10 |
| 2006/0052223 | A1 * | 3/2006 | Terry | A63B 21/0004<br>482/126 |
| 2010/0323852 | A1 * | 12/2010 | Locsin | A63B 1/00<br>482/96 |

* cited by examiner

EXERCISER DEVICE INCLUDING HANDLES WITH SPRINGS

BACKGROUND OF THE INVENTION

The present invention relates to an exerciser device and, more particularly, to an exerciser device including handles with springs to provide muscle strength training of various muscles on different parts of a human body through shouldering and manual operations.

A conventional rod-like exerciser includes a tension spring attached between two handles. A user can hold the two handles with both hands and move the two handles toward each other to thereby bend the tension spring. The bending deformation and the resilient returning force of the tension spring squeeze the muscles of the wrists, arms, chest, and abdomen to achieve an exercising effect. However, the conventional rod-like exerciser cannot exercise the muscles on the back and shoulders. Exercise of the muscles on the back and shoulders can only be trained by various weight lifting devices that occupy a considerable space, that are expensive and, thus, that are not suitable for ordinary families.

Thus, a need exists for a novel exerciser device that mitigates and/or obviates the above drawbacks.

BRIEF SUMMARY OF THE INVENTION

An exerciser device according to the present invention includes a yoke having a first end and a second end spaced from the first end in an axial direction. The yoke further includes a neck between the first and second ends. Two handle units are respectively mounted to the first and second ends of the yoke. Each of the two handle units includes a handle and a tension spring mounted between the handle and the yoke.

In an example, each of the two handle units further includes a positioning coupler mounted between the tension spring thereof and the yoke. The positioning coupler includes an engaging section and a positioning section spaced from the engaging section in the axial direction. The tension spring of each of the two handle units includes first and second ends spaced from each other in the axial direction. The engaging section of each positioning coupler is coupled with the second end of one of the tension springs. The positioning sections of the positioning couplers are respectively coupled with the first and second ends of the yoke.

In an example, each positioning coupler includes a pin extending perpendicularly to the axial direction. An elastic washer is mounted around the positioning section. The yoke is a tubular structure. Each of the first and second ends of the yoke includes a coupling groove having a longitudinal section extending into the tubular structure of the yoke in the axial direction and a transverse section extending transversely to an inner end of the longitudinal section. The positioning sections of the positioning couplers of the two handle units are respectively inserted into the first and second ends of the yoke. The pin of each positioning coupler is movable into the transverse section of a corresponding one of the coupling grooves to securely engage a corresponding one of the two handle units with the yoke. Furthermore, the pin of each positioning coupler is movable into the longitudinal section of the corresponding one of the coupling groove to permit disengagement of the corresponding one of the two handle units from the yoke.

In an example, the neck of the yoke includes an angled portion. A first inclined section extends between the angled portion and the first end of the yoke. A first bend is formed between the first inclined section and the angled portion. A second inclined section extends between the angled portion and the second end of the yoke. A second bend is formed between the second inclined section and the angled portion. A spacing between the first and second ends of the yoke is larger than a spacing between the first and second bends of the neck. The first and second inclined sections have substantially the same length.

In an example, the handle of each of the two handle units includes first and second connection ends, a gripping portion between the first and second connection ends, a straddling section between the gripping section and the first connection end, and an elbow between the straddling section and the gripping section. The gripping section is at an obtuse angle to the straddling section.

In an example, a pull string includes two ends respectively with two hooks. The handle of each of the two handle units includes a ring detachably engaged with one of the two hooks of the pull string.

In an example, a protective jacket is mounted around an outer periphery of the yoke.

In an example, two protective covers are provided. Each of the two protective covers is mounted around an outer periphery of the handle of one of the two handle units.

In an example, each of the two handle units further includes a fixing coupler mounted between the tension spring and the handle thereof. Each fixing coupler includes a fixing section and a coupling section spaced from the fixing section in the axial direction. Each handle further includes first and second connection ends. The fixing section of each fixing coupler is detachably engaged with the first connection end of one of the handles. The coupling section of each fixing coupler is coupled to the first end of one of the tension springs.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
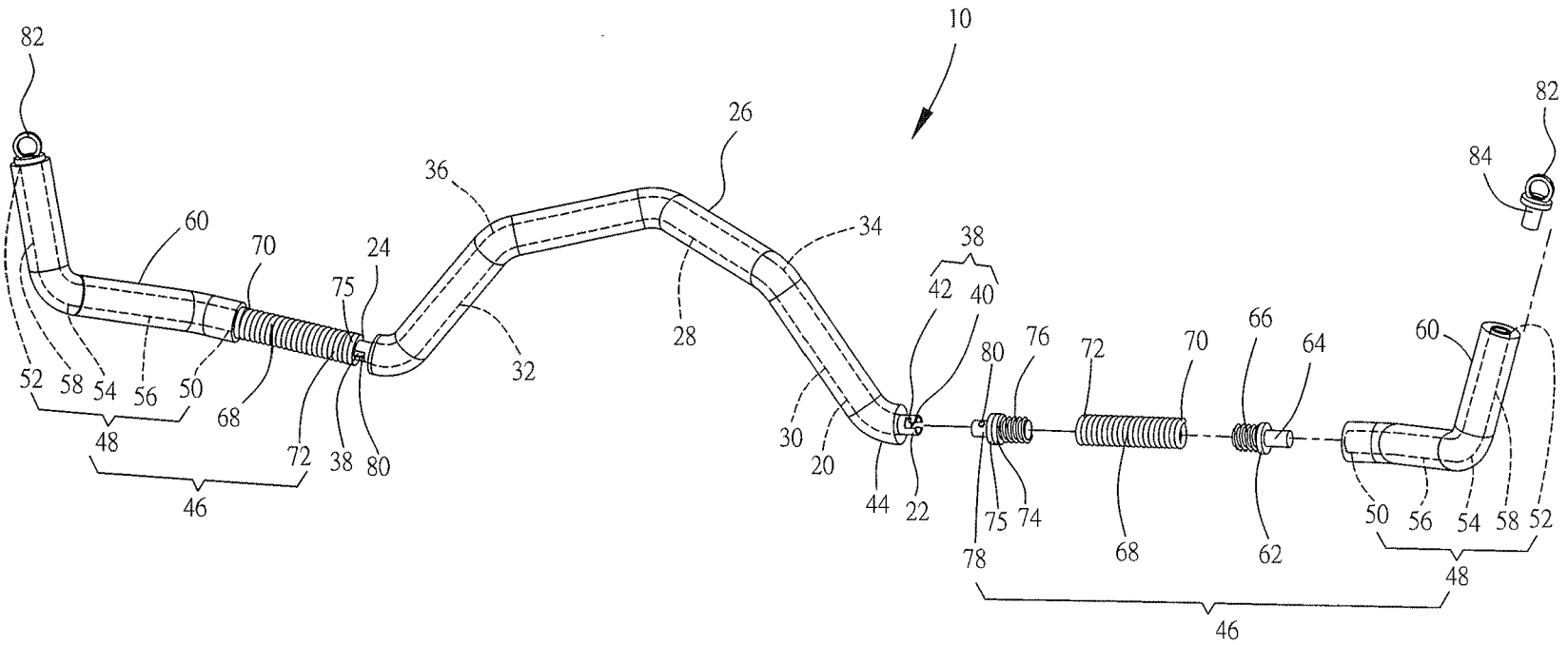
FIG. 1 is an exploded, perspective view of an exerciser device according to the present invention.
Figure 2:
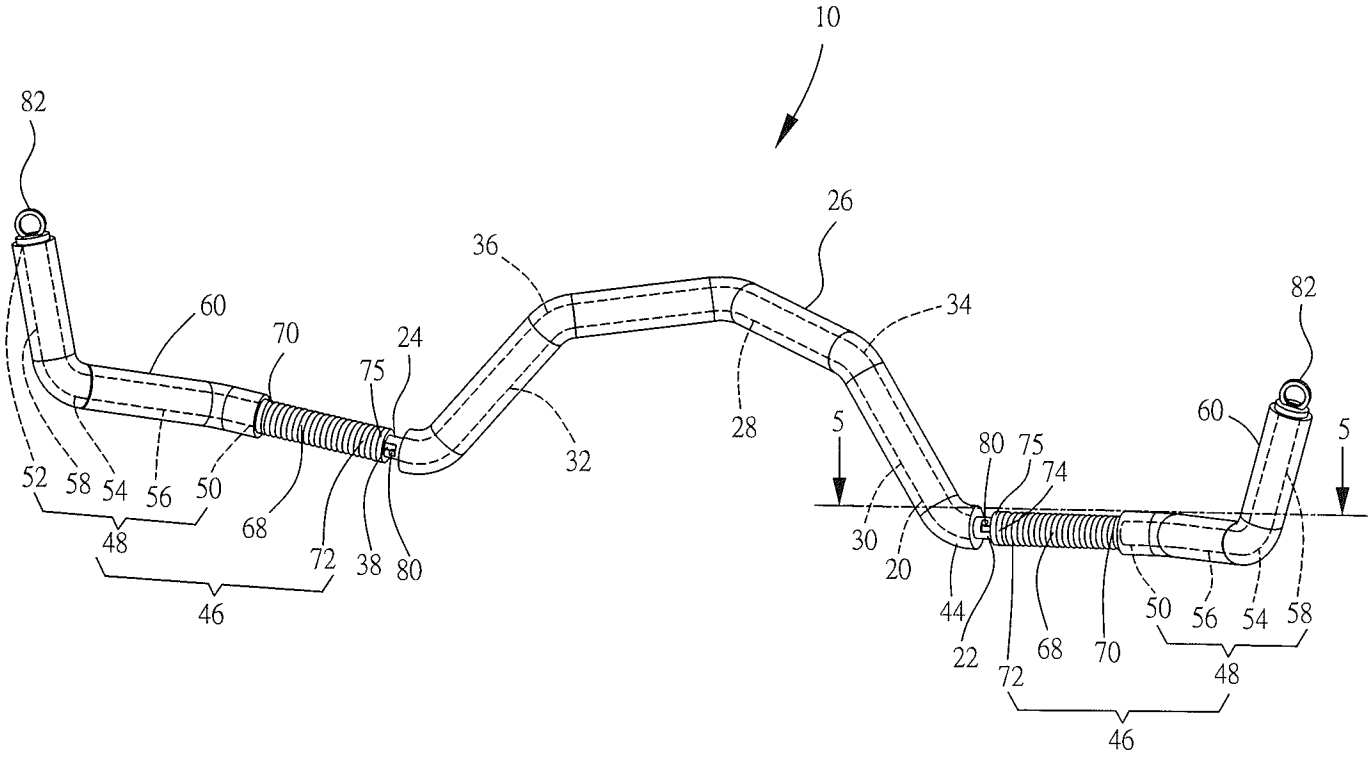
FIG. 2 is a perspective view of the exerciser device of FIG. 1.
Figure 3:
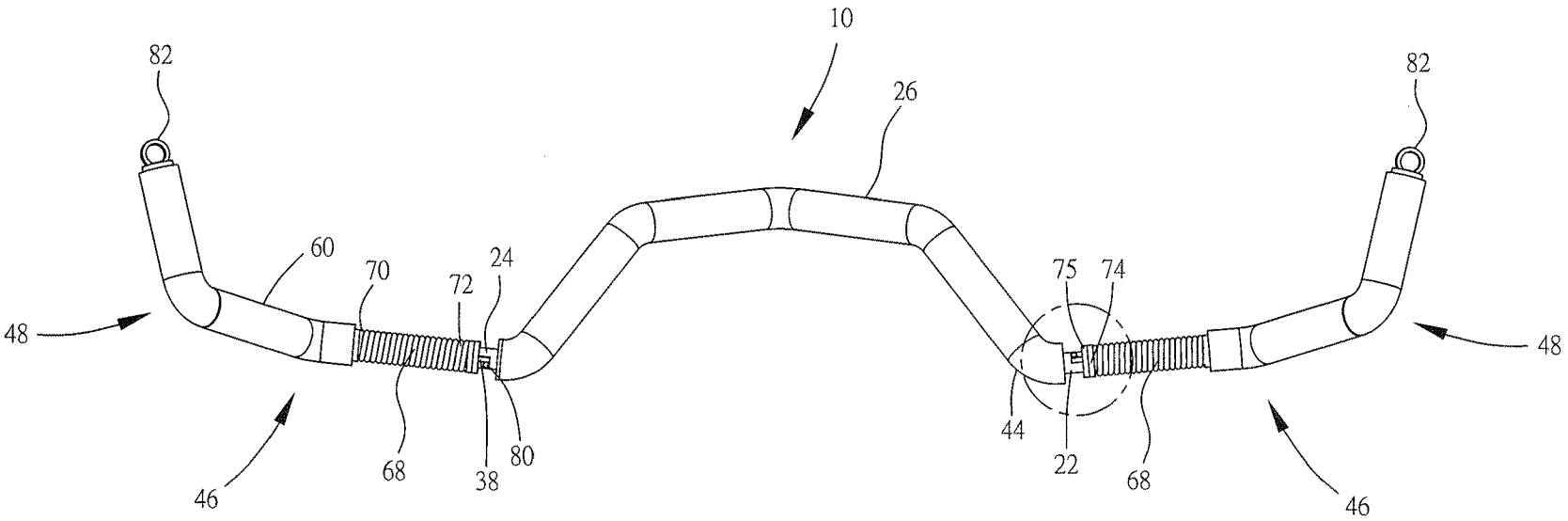
FIG. 3 is a front elevational view of the exerciser device of FIG. 1.
Figure 4:
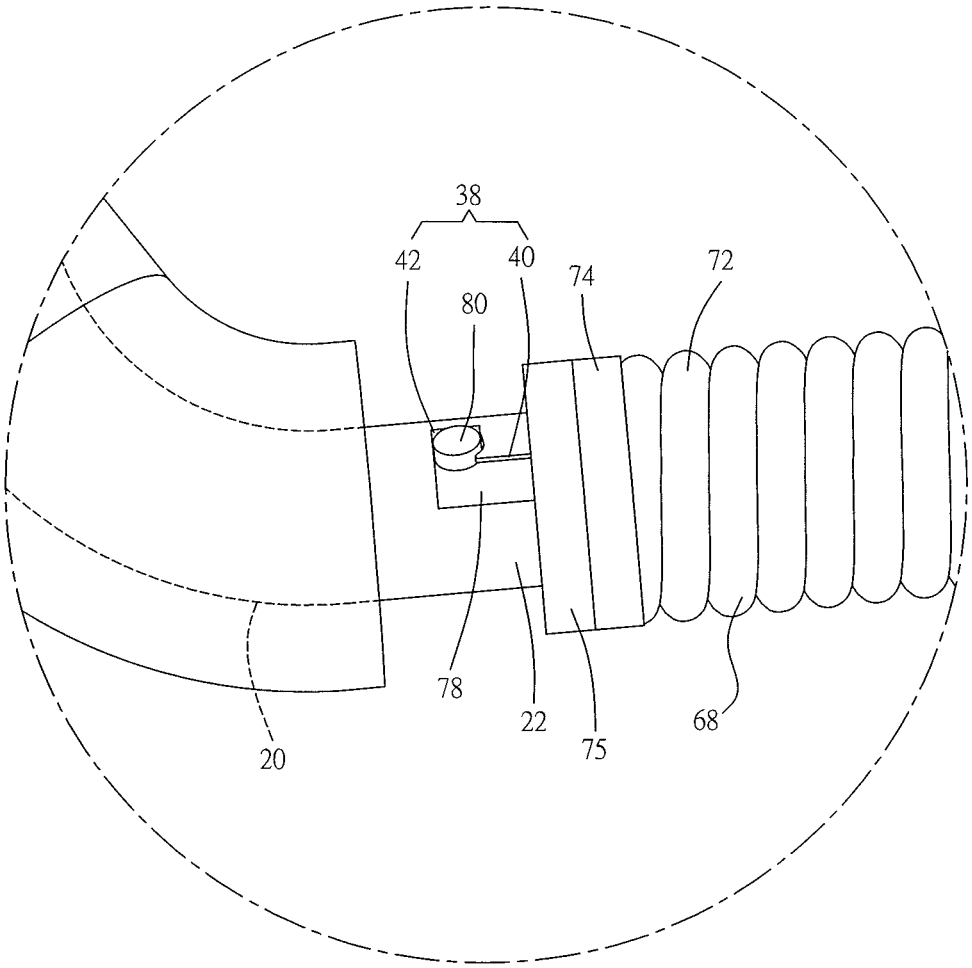
FIG. 4 is an enlarged view of a circled portion of FIG. 3.
Figure 5:
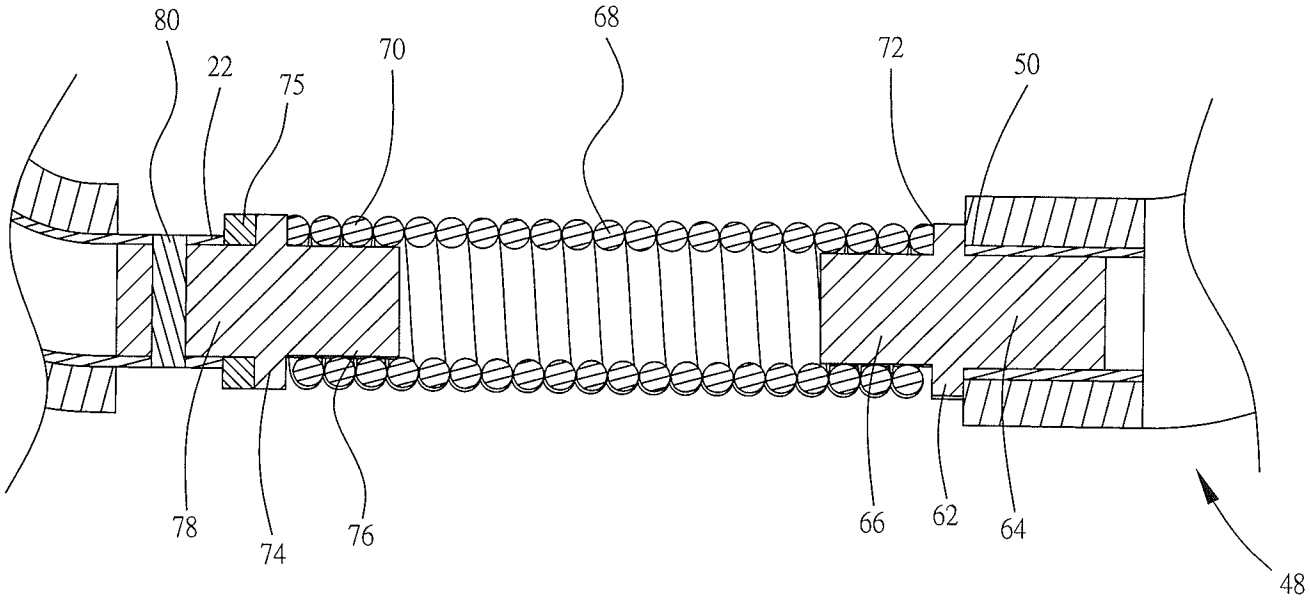
FIG. 5 is an enlarged cross view taken along section line 5-5 of FIG. 2.
Figure 6:
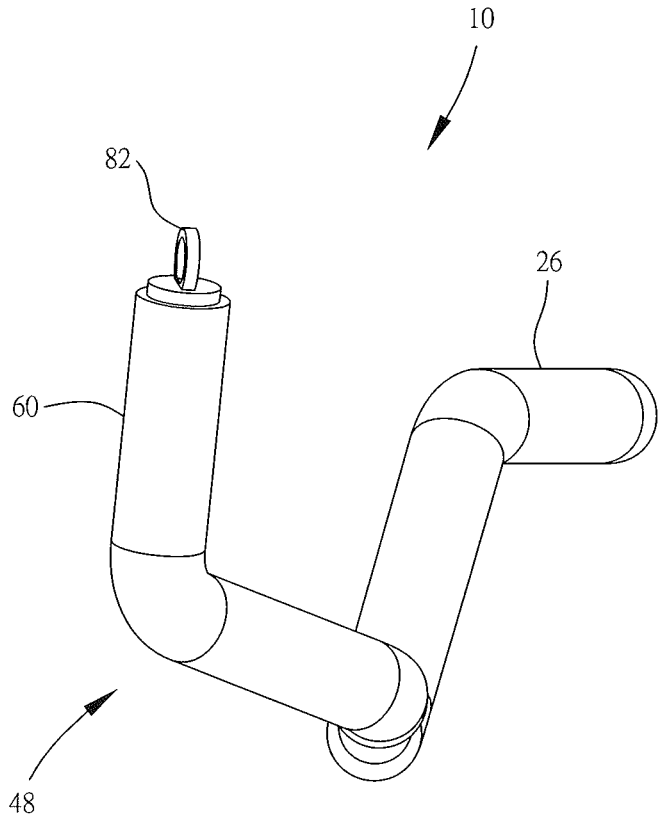
FIG. 6 is a side elevational view of the exerciser device of FIG. 2.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "end", "portion", "section", "axial", "spacing", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to FIGS. 1-6, an exerciser device 10 according to the present invention includes a yoke 20 and two handle units 46. The yoke 20 is formed by bending a metal tube and, thus, has a tubular structure in this embodiment. A protective jacket 44 made of plastic or rubber material is mounted around an outer periphery of the yoke 20. The yoke 20 includes a first end 22 and a second end 24 spaced from the first end 22 in an axial direction. The yoke 20 further includes a neck 26 between the first and second ends 22 and 24. The neck 26 of the yoke 20 includes an angled portion 28.

A first inclined section 30 extends between the angled portion 28 and the first end 22 of the yoke 20. A first bend 34 is formed between the first inclined section 30 and the angled portion 28. A second inclined section 32 extends between the angled portion 28 and the second end 24 of the yoke 20. A second bend 36 is formed between the second inclined section 32 and the angled portion 28. The first and second inclined sections 30 and 32 have substantially the same length. An opening is formed in the yoke 20 between the first and second ends 22 and 24. A spacing between the first and second ends 22 and 24 of the yoke 20 is larger than a spacing between the first and second bends 34 and 36 of the neck 26.

Each of the first and second ends 22 and 24 of the yoke 20 includes a coupling groove 38 having a longitudinal section 40 extending into the tubular structure of the yoke 20 in the axial direction and a transverse section 42 extending transversely to an inner end of the longitudinal section 40. An intersection between the longitudinal section 40 and the transverse section 42 includes a narrow opening having a width smaller than the remaining portion of the transverse section 42. The width of the remaining portion of the transverse section 42 is substantially the same as the width of the longitudinal section 40.

With reference to FIGS. 1-4, the two handle units 46 are respectively and detachably mounted to the first and second ends 22 and 24 of the yoke 20. Each of the two handle units 46 includes a handle 48, a fixing coupler 62, a tension spring 68, and a positioning coupler 74. Each handle 48 is formed by bending a metal tube. Two protective covers 60 made of plastic or rubber material are provided. Each protective cover 60 is mounted around an outer periphery of one of the handles 48.

The handle 48 of each of the two handle units 46 includes first and second connection ends 50 and 52, a gripping portion 58 between the first and second connection ends 50 and 52, a straddling section 56 between the gripping section 58 and the first connection end 50, and an elbow 54 between the straddling section 56 and the gripping section 58. The gripping section 58 is at a non-parallel angle (an obtuse angle in this embodiment) to the straddling section 56 which is at a non-parallel angle to the first connection end 50. The handle 46 of each of the two handle units 46 includes a ring 82 with a stub 84. The stub 84 of each ring 82 can be glued and inserted into the second connection end 52 of one of the handles 48.

The fixing coupler 62 of each of the two handle units 46 includes a fixing section 64 and a coupling section 46 spaced from the fixing section 64 in the axial direction. In this embodiment, the coupling section 66 of each fixing coupler 62 includes an outer thread. The fixing section 64 of each fixing coupler 62 is aligned with the first connection end 50 of one of the handles 48. Each tension spring 68 is tubular, is in the form of a coil spring in this embodiment and includes first and second ends 70 and 72 spaced from each other in the axial direction. The first end 70 of each tension spring 68 is aligned with the coupling section 66 of one of the fixing couplers 62.

Each positioning coupler 74 includes an engaging section 76 and a positioning section 78 spaced from the engaging section 76 in the axial direction. In this embodiment, the engaging section 76 has an outer thread. Each positioning coupler 78 further includes a pin 80 extending perpendicularly to an outer surface of the positioning section 78 thereof and extending substantially perpendicularly to the axial direction. The pin 80 of each positioning coupler 74 can extend into the transverse section 42 of a corresponding one of the coupling grooves 38 to securely engage a corresponding one of the two handle units 46 with the yoke 20. The pin 80 of each positioning coupler 74 is movable into the longitudinal section 40 of the corresponding one of the coupling groove 38 to permit disengagement of the corresponding one of the two handle units 46 from the yoke 20. The engaging section 76 of each positioning coupler 74 is aligned with the second end 72 of one of the tension springs 68. The positioning sections 78 of the positioning couplers 74 are respectively aligned with the first and second ends 22 and 24 of the yoke 20.

With reference to FIGS. 1-4, the handles 48 are coupled with the tension springs 68. The fixing section 64 of each fixing coupler 62 is detachably engaged with the first connection end 50 of one of the handles 48. In this embodiment, the fixing section 64 of each fixing coupler 62 is force-fitted into the first connection end 50 of one of the handles 48. Glue is applied to the outer thread of the coupling section 66 of each fixing coupler 62. The coupling section 66 of each fixing coupler 62 is threaded into and bonded to the first end 70 of one of the tension springs 68.

Each tension spring 68 is coupled with one of the positioning couplers 74. In this embodiment, glue is applied to the outer thread of the engaging section 76 of each positioning coupler 74. The engaging section 76 of each positioning coupler 74 is threaded into and bonded to the second end 72 of one of the tension springs 68.

The two handle units 46 are respectively and detachably mounted to the first and second ends 22 and 24 of the yoke 20. An elastic washer 75 made of plastic or rubber material is mounted around the positioning section 78 of each positioning coupler 74. The positioning sections 78 of the positioning couplers 74 of the two handle units 46 are respectively inserted into the first and second ends 22 and 24 of the yoke 20. When each pin 80 reaches an inner end of the longitudinal section 40 of one of the coupling grooves 38, an abutment face of each positioning coupler 74 presses against the corresponding elastic washer 75. At this time, each positioning coupler 74 can be rotated, and the elastic returning force of each elastic washer 75 urges a corresponding pin 80 to press against a wall face of a corresponding transverse section 42 after the pin 80 moves into the transverse section 42. If it is desired to detach the two handles 46, each positioning coupler 74 is rotated in a reverse direction to move the corresponding pin 80 back to the corresponding longitudinal section 40, permitting subsequent disengagement from the corresponding coupling groove 38 via the corresponding longitudinal section 40, thereby disengaging the two handles 46 from the yoke 20.

Figure 7:
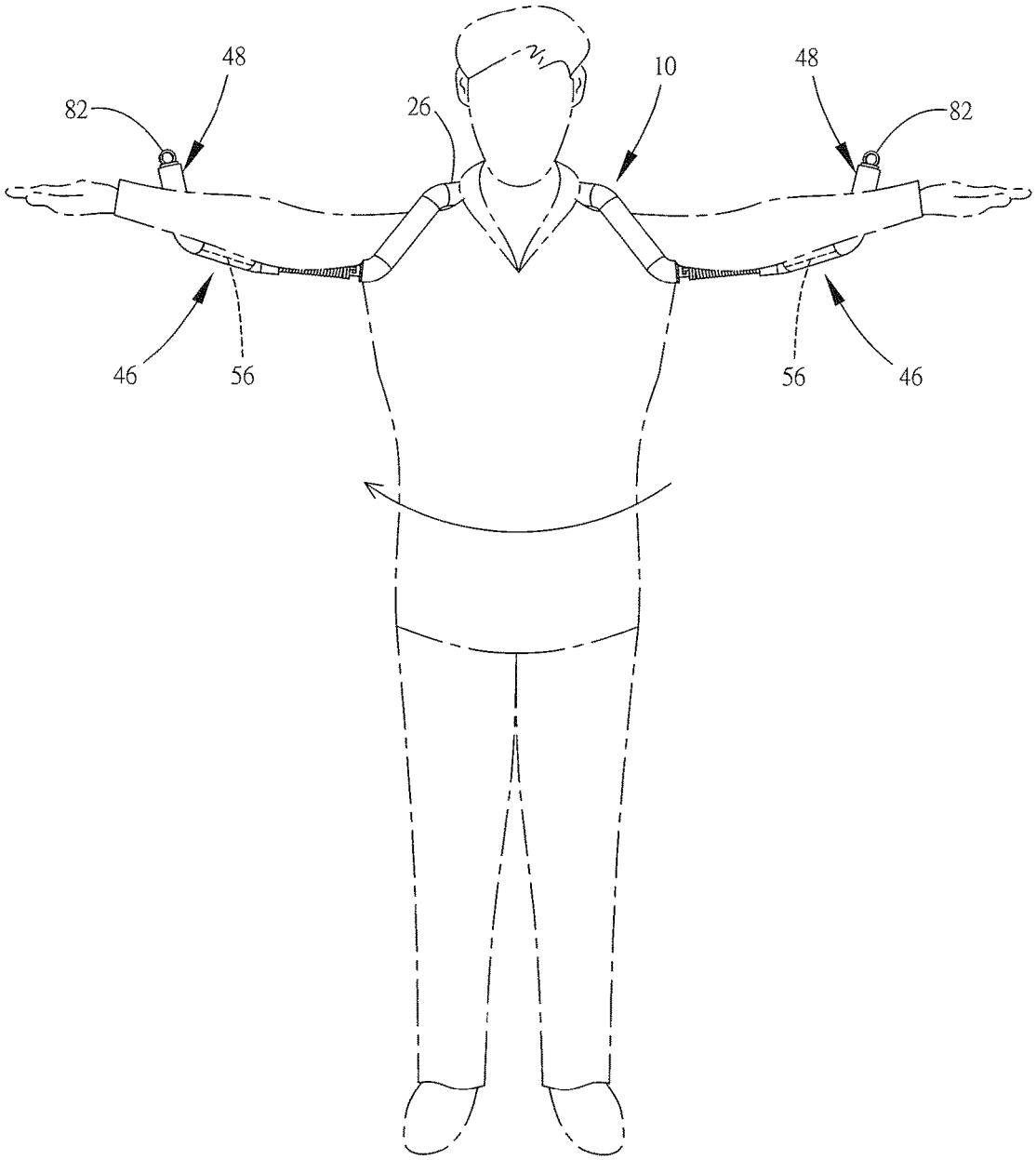
FIG. 7 is a diagrammatic view illustrating use of the exerciser device on shoulders of a user, with both hands of the user straddling two handles of the exerciser device, permitting the user to turn the upper body.

With reference to FIG. 7, in use, the user shoulders the yoke 20. The angled portion 28 of the neck 26 surrounds the neck of the user. Thus, the yoke 20 abuts the shoulders and the back of the neck of the user, and the two handle units 46 are on two sides of the shoulders of the user. The two arms of the user can rest on and be supported by the straddling sections 56 of the two handle units 46, such that the user can turn his or her upper body for warming up purposes while keeping the chest out and keeping the body straight.

Figure 8:
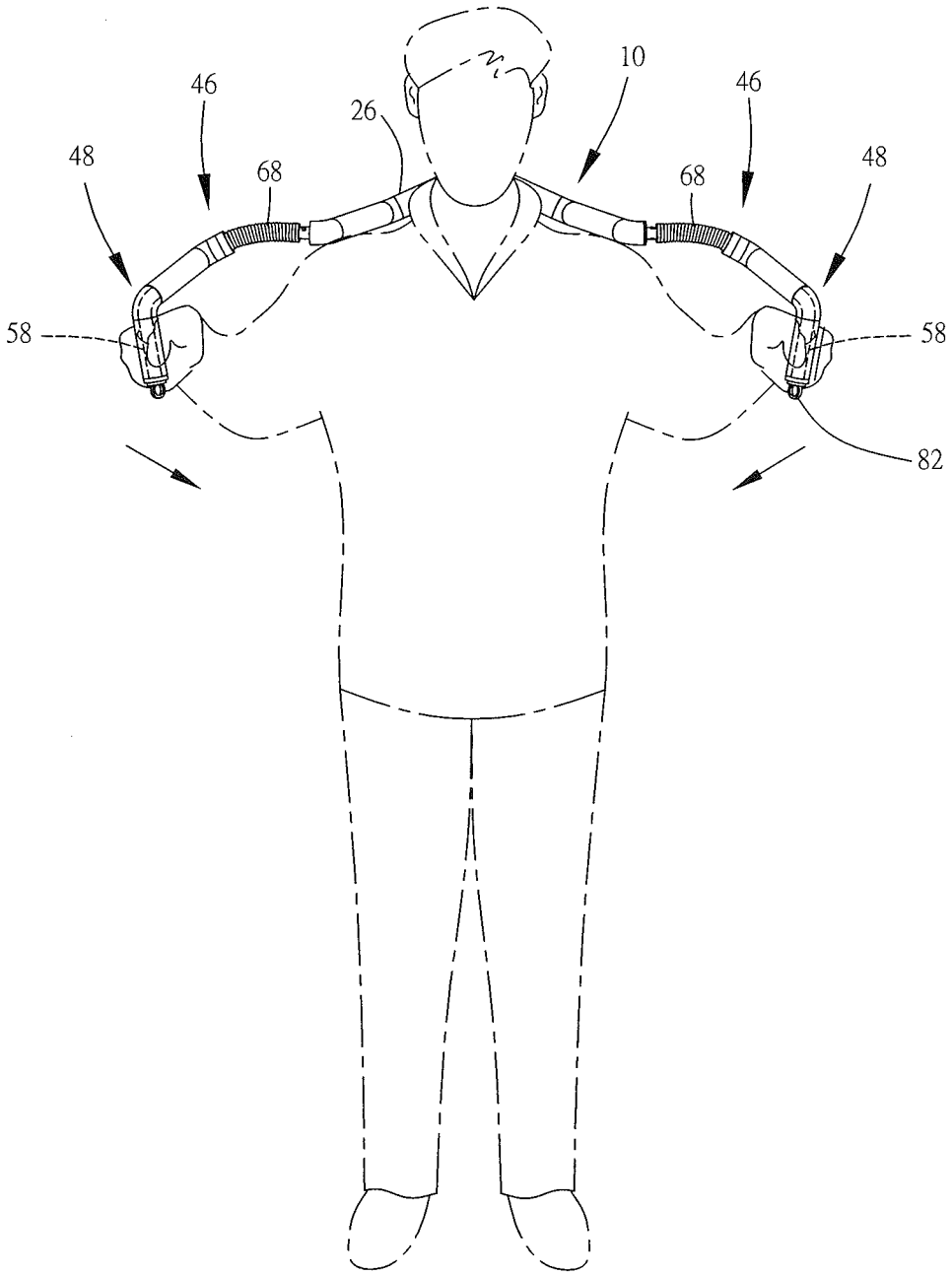
FIG. 8 is a diagrammatic view illustrating use of the exerciser device on the shoulders of the user, with both hands of the user respectively holding the two handles and applying forces to stretch springs.

With reference to FIG. 8, in another use, the user shoulders the yoke 20 and holds the handles 48 with both hands. The first and second ends 22 and 24 of the yoke 20 abut against the shoulders of the user. The user can apply forces to move the handles 48 toward each other, such that the yoke 20 presses against the back of the neck and shoulders of the user. Furthermore, each tension spring 68 is deformed, and muscle strength training of the muscles on the wrists, arms, chest, and abdomen of the user can be proceed by the elastic returning forces of the tension springs 68. At this time, since the forces applied by the hands of the user to the handles 48 can be transmitted to the yoke 20, muscle strength training (including pressing and release) can proceed on the muscles at the shoulders and the back of the user.

Figure 9:
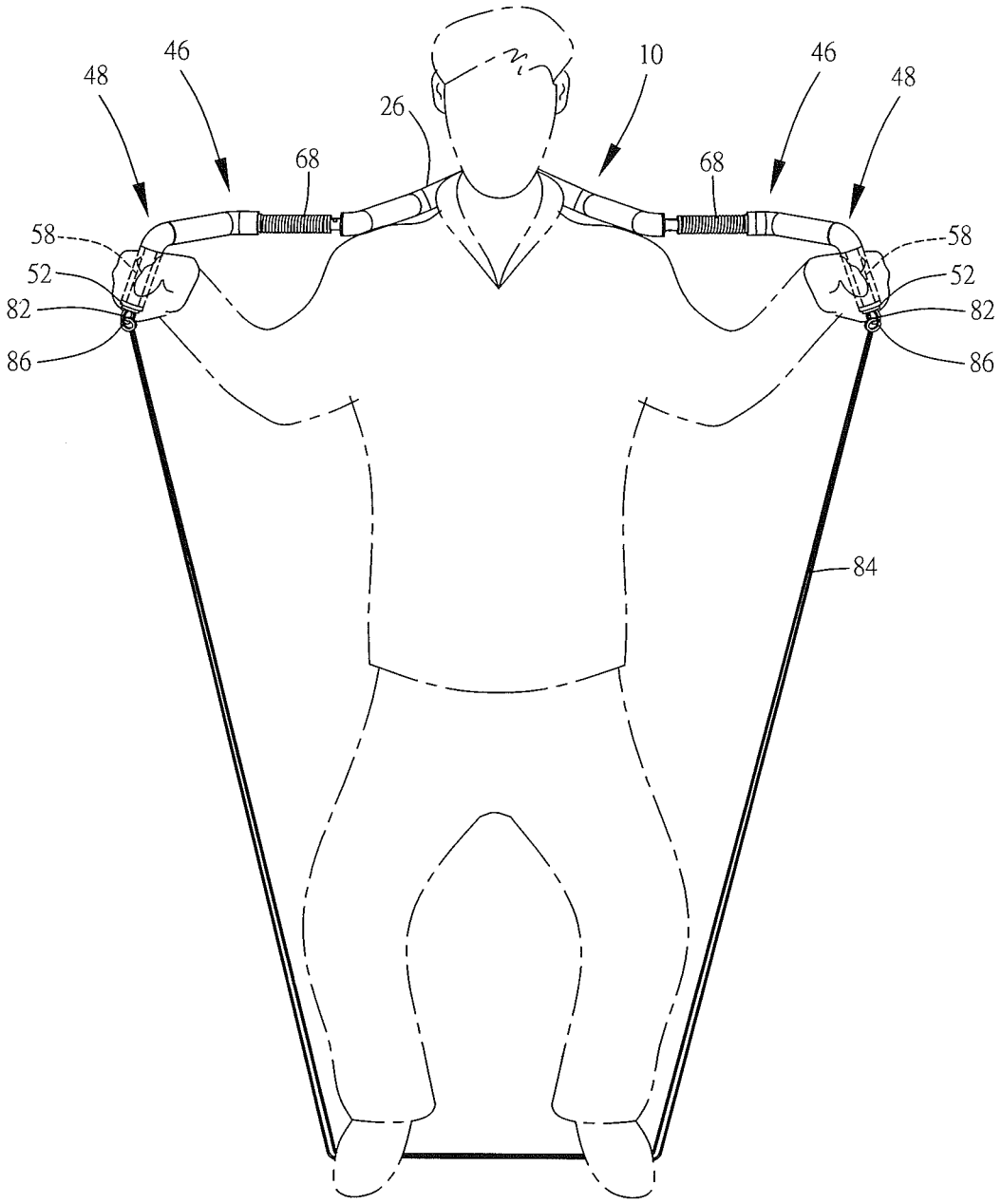
FIGS. 9 and 10 are diagrammatic views illustrating use of the exerciser device and a pull string, wherein the user squats and stands up to exercise muscles on different parts of the body of the user.
Figure 10:
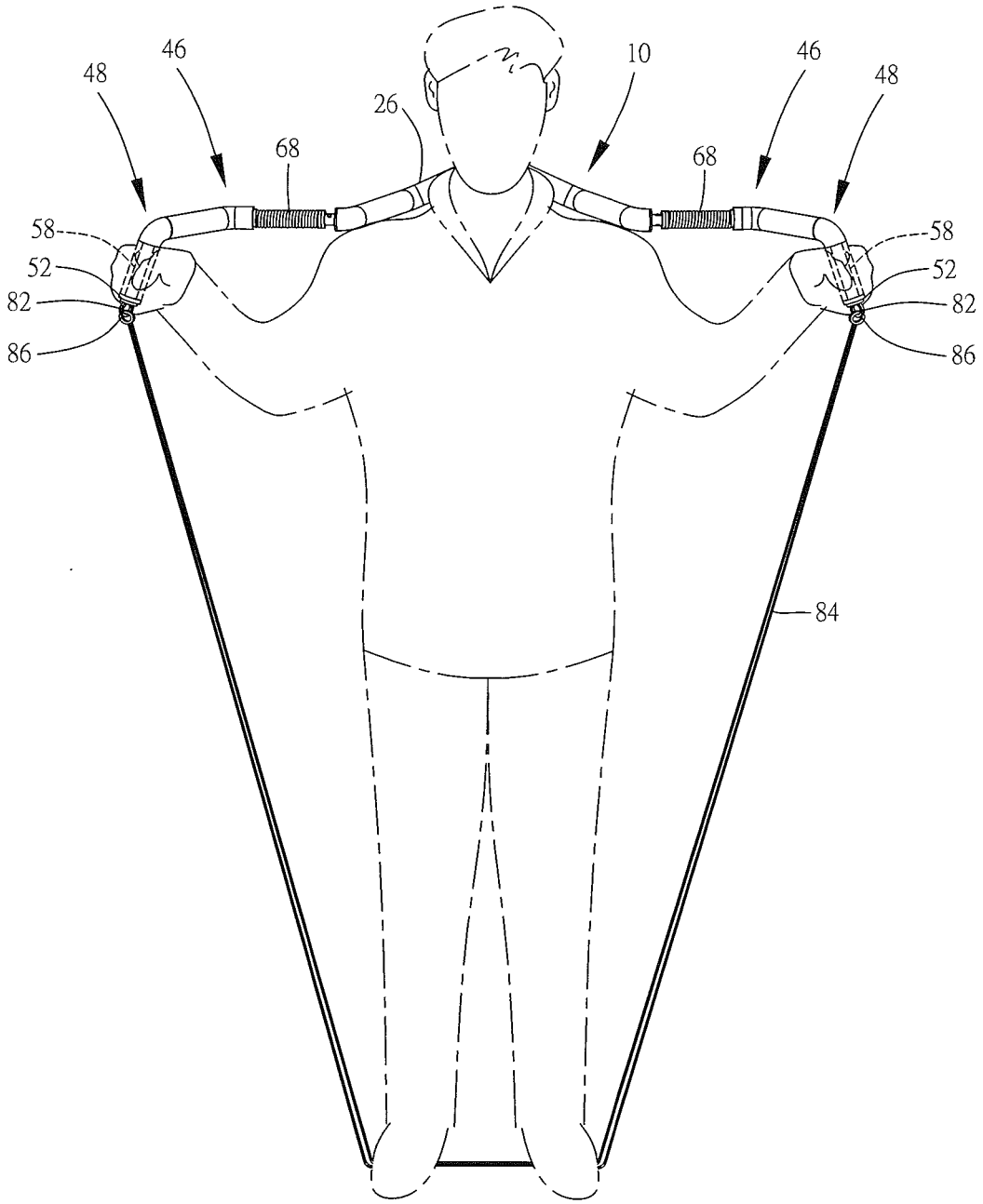

With reference to FIGS. 9 and 10, the exerciser device 10 can further include a pull string 86 having two ends respectively with two hooks 88. The ring 82 of each handle 46 is detachably engaged with one of the two hooks 88 of the pull string 86. In use of the exerciser device 10 with the pull string 86 coupled with the rings 82, the user shoulders the yoke 20, holds the handles 48 with both hands, and steps on an intermediate portion of the pull string 86 with left and right portions of the pull string 86 located on two sides of the user, as shown in FIG. 9. In addition to apply forces to bend the tension springs 68, the user can squat and stand up to press and stretch the muscles at the legs, shoulders, hands, abdomen, and the back of the user the muscles and can proceed with muscle strength training on the muscles at the arms, shoulders, back, and abdomen of the user. Specifically, when the user squats, the user can feel the pulling force of the pull string 86 imparted to the yoke 20, such that the muscles at the shoulders, back, and legs of the user can be compressed by withstanding the pulling force of the pull string 86. When the user stands up, the elastic returning force of the pull string 86 is imparted to the shoulders, back, chest, waist, and legs of the user to proceed with weight training of the muscles at various parts of the body of the user.

The two handle units 46 can be detached from the yoke 20 to reduce the package volume, which is advantageous to packaging, transportation, and reducing the space for storage. Furthermore, when the tension springs 68 fatigue after a period of time of use of the exerciser device 10, or the fixing couplers 62 and the positioning couplers 74 wear, only replacement of the tension springs 68, the fixing couplers 62 and the positioning couplers 74 is required. Thus, the exerciser device 10 is easy to repair and maintain.

Now that the basic teachings of the present invention have been explained, many extensions and variations will be obvious to one having ordinary skill in the art. For example, the tension springs 68 can be plate springs, and the coupling section 66 of each fixing coupler 62 can welded to the first end 70 of one of the tension springs 68 in the form of a plate spring. Furthermore, the engaging section 76 of each positioning coupler 74 can be plate-like and welded to the second end 72 of one of the tension springs 68 in the form of a plate spring. Furthermore, each of the first and second ends 22 and 24 of the yoke 20 can have a through-hole to replace the coupling groove 38, each of the positioning couplers 74 can have a screw hole to replace the pin 80, and a screw extends into the through-hole and the screw hole for positioning purposes, which can be appreciated by one having ordinary skill in the art.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An exerciser device comprising:

a yoke including a first end and a second end spaced from the first end in an axial direction, with the yoke further including a neck between the first and second ends; and two handle units respectively mounted to the first and second ends of the yoke, with each of the two handle units including a handle and a tension spring mounted between the handle and the yoke, with each of the two handle units further including a positioning coupler mounted between the tension spring thereof and the yoke, with the positioning coupler including an engaging section and a positioning section spaced from the engaging section in the axial direction, with the tension spring of each of the two handle units including first and second ends spaced from each other in the axial direction, with the engaging section of each positioning coupler coupled with the second end of one of the tension springs, and with the positioning sections of the positioning couplers respectively coupled with the first and second ends of the yoke.

2. The exerciser device as claimed in claim 1, with each positioning coupler including a pin extending perpendicularly to the axial direction, with an elastic washer mounted around the positioning section, with the yoke being a tubular structure, with each of the first and second ends of the yoke including a coupling groove having a longitudinal section extending into the tubular structure of the yoke in the axial direction and a transverse section extending transversely to an inner end of the longitudinal section, with the positioning sections of the positioning couplers of the two handle units respectively inserted into the first and second ends of the yoke, with the pin of each positioning coupler movable into the transverse section of a corresponding one of the coupling grooves to securely engage a corresponding one of the two handle units with the yoke, and with the pin of each positioning coupler movable into the longitudinal section of the corresponding one of the coupling groove to permit disengagement of the corresponding one of the two handle units from the yoke.

3. An exerciser device comprising:

a yoke including a first end and a second end spaced from the first end in an axial direction, with the yoke further including a neck between the first and second ends; and two handle units respectively mounted to the first and second ends of the yoke, with each of the two handle units including a handle and a tension spring mounted between the handle and the yoke, with the neck of the yoke including an angled portion, with a first inclined section extending between the angled portion and the first end of the yoke, with a first bend formed between the first inclined section and the angled portion, with a second inclined section extending between the angled portion and the second end of the yoke, with a second bend formed between the second inclined section and the angled portion, with a spacing between the first and second ends of the yoke being larger than a spacing between the first and second bends of the neck, and with the first and second inclined sections having substantially a same length.

4. An exerciser device comprising:

a yoke including a first end and a second end spaced from the first end in an axial direction, with the yoke further including a neck between the first and second ends; and two handle units respectively mounted to the first and second ends of the yoke, with each of the two handle units including a handle and a tension spring mounted between the handle and the yoke, with the handle of each of the two handle units including first and second connection ends, a gripping portion between the first and second connection ends, a straddling section between the gripping section and the first connection end, and an elbow between the straddling section and the gripping section, and with the gripping section being at an obtuse angle to the straddling section.

5. The exerciser device as claimed in claim 1, further comprising a pull string including two ends respectively with two hooks, with the handle of each of the two handle units including a ring detachably engaged with one of the two hooks of the pull string.

6. The exerciser device as claimed in claim 1, further comprising a protective jacket mounted around an outer periphery of the yoke.

7. The exerciser device as claimed in claim 1, further comprising two protective covers, with each of the two protective covers mounted around an outer periphery of the handle of one of the two handle units.

8. An exerciser device comprising:

a yoke including a first end and a second end spaced from the first end in an axial direction, with the yoke further including a neck between the first and second ends; and two handle units respectively mounted to the first and second ends of the yoke, with each of the two handle units including a handle and a tension spring mounted between the handle and the yoke, with each of the two handle units further including a fixing coupler mounted between the tension spring and the handle thereof, with each fixing coupler including a fixing section and a coupling section spaced from the fixing section in the axial direction, with each handle further including first and second connection ends, with the fixing section of each fixing coupler detachably engaged with the first connection end of one of the handles, and with the coupling section of each fixing coupler coupled to the first end of one of the tension springs.

9. The exerciser device as claimed in claim 1, with the neck of the yoke including an angled portion, with a first inclined section extending between the angled portion and the first end of the yoke, with a first bend formed between the first inclined section and the angled portion, with a second inclined section extending between the angled portion and the second end of the yoke, with a second bend formed between the second inclined section and the angled portion, with a spacing between the first and second ends of the yoke being larger than a spacing between the first and second bends of the neck, and with the first and second inclined sections having substantially a same length.

10. The exerciser device as claimed in claim 1, with the handle of each of the two handle units including first and second connection ends, a gripping portion between the first and second connection ends, a straddling section between the gripping section and the first connection end, and an elbow between the straddling section and the gripping section, and with the gripping section being at an obtuse angle to the straddling section.

11. The exerciser device as claimed in claim 1, with each of the two handle units further including a fixing coupler mounted between the tension spring and the handle thereof, with each fixing coupler including a fixing section and a coupling section spaced from the fixing section in the axial direction, with each handle further including first and second connection ends, with the fixing section of each fixing coupler detachably engaged with the first connection end of one of the handles, and with the coupling section of each fixing coupler coupled to the first end of one of the tension springs.

12. The exerciser device as claimed in claim 3, with the handle of each of the two handle units including first and second connection ends, a gripping portion between the first and second connection ends, a straddling section between the gripping section and the first connection end, and an elbow between the straddling section and the gripping section, and with the gripping section being at an obtuse angle to the straddling section.

13. The exerciser device as claimed in claim 3, with each of the two handle units further including a fixing coupler mounted between the tension spring and the handle thereof, with each fixing coupler including a fixing section and a coupling section spaced from the fixing section in the axial direction, with each handle further including first and second connection ends, with the fixing section of each fixing coupler detachably engaged with the first connection end of one of the handles, and with the coupling section of each fixing coupler coupled to the first end of one of the tension springs.

14. The exerciser device as claimed in claim 4, with each of the two handle units further including a fixing coupler mounted between the tension spring and the handle thereof, with each fixing coupler including a fixing section and a coupling section spaced from the fixing section in the axial direction, with each handle further including first and second connection ends, with the fixing section of each fixing coupler detachably engaged with the first connection end of one of the handles, and with the coupling section of each fixing coupler coupled to the first end of one of the tension springs.

* * * * *